United States Patent [19]

Kobe

[11] Patent Number: 4,785,973

[45] Date of Patent: Nov. 22, 1988

[54] ATTACHMENT FOR USE IN LIQUID FILLING CONTAINERS

[75] Inventor: Susumu Kobe, Tokyo, Japan

[73] Assignee: The Coca-Cola Company, Atlanta, Ga.

[21] Appl. No.: 903,502

[22] Filed: Sep. 4, 1986

[30] Foreign Application Priority Data

Sep. 4, 1985 [JP] Japan ..... 60-193787

[51] Int. Cl.[4] ..... B67B 7/24

[52] U.S. Cl. ..... 222/82; 222/400.7; 137/322

[58] Field of Search ..... 222/82, 81, 83, 89, 222/91, 80, 394, 541, 481, 400.7, 399, 88, 464, 382; 137/212, 322

[56] References Cited

U.S. PATENT DOCUMENTS

| | | | |
|---|---|---|---|
| 718,163 | 1/1903 | Sherrard | 222/82 |
| 1,995,098 | 3/1935 | Healy | 222/82 |
| 2,223,012 | 11/1940 | Wanderski et al. | 222/400.7 |
| 2,845,201 | 7/1958 | Henry | 222/89 |
| 3,186,599 | 6/1965 | Levinson et al. | 222/82 |
| 3,464,435 | 9/1969 | Lamb | 137/212 |
| 3,498,313 | 3/1970 | Belich | 222/400.7 |
| 3,868,049 | 2/1975 | Johnston | 222/400.7 |
| 4,212,373 | 7/1980 | Scragg | 222/89 |
| 4,582,223 | 4/1986 | Kobe | 222/91 |

FOREIGN PATENT DOCUMENTS 1454994 9/1966 France .

*Primary Examiner*—Joseph J. Rolla
*Assistant Examiner*—Kenneth Noland
*Attorney, Agent, or Firm*—Birch, Stewart, Kolasch & Birch

[57] ABSTRACT

An attachment for a syrup container for a post-mix beverage apparatus permits syrup to be dispensed while the container is in an upright condition. Conduits are provided in the attachment for supplying carbon dioxide gas under pressure into the container to propel the syrup therefrom.

4 Claims, 2 Drawing Sheets

ATTACHMENT FOR USE IN LIQUID FILLING CONTAINERS

BACKGROUND OF THE INVENTION

The present invention relates to an attachment for use in discharging a liquid in a container by fastening the attachment to the container filled with the liquid and causing a gas-like carbon dioxide gas to flow into the container.

The post-mix type soft drink vending machine is known as an apparatus by which a concentrated syrup, i.e., a concentrate such as cola or juice and carbonated water and/or water, are mixed in a cup.

As described in Japanese Laid-Open Patent Application No. 59-27389, there has been proposed a new method for conveying a concentrated syrup to such a vending machine and for mixing such syrup.

In the above method, for example, by sealing the top opening of a container filled with a concentrated syrup with a sealant, the container was conveyed to a vending machine and an attachment was fastened to the opening of the container in a normally placed state, i.e., in a state of the neck positioned in an upright position. Then the container was disposed in any fixed position within the vending machine in an inverted state, namely, in a condition of the opening situated downward by inverting it.

It has become clear that in the above method, there are the following problems at the time of its inverted use. That is:

(1) an operation of inverting the container is relatively troublesome and forces an operator to do extra work;

(2) locating the container in an inverted state requires a device for hanging the container, thereby to render its structure complex; and (3) when the container is located in an inverted state, a concentrated syrup adheres to the entire face of a gasket for the attachment, in consequence of which this concentrated syrup makes its vicinity dirty by dripping or the concentrated syrup sticks firmly to the screw attached part of the attachment at the time of exchanging containers, whereby inhibiting the sealability between the container and attachment.

SUMMARY OF THE INVENTION

According to the present invention, the above problems and any other problem are solved by providing an attachment for use in discharging a liquid from an upright container filled with the liquid having a threaded portion at the neck and an opening at the end of the neck sealed with a thin sealant, said attachment comprising a gas inlet for causing gas to flow into the container through an inflow conduit connected to a gas source, a gas outlet for causing gas to effuse into said container, a fluid inlet for causing a liquid to flow in from the internal part of the container and a fluid outlet for causing the fluid to effuse into an outflow conduit to which said fluid outlet is connected, characterized in that said attachment comprise a first tube, a second tube arranged coaxially relative to the first tube and inside the first tube, and a threaded part supported by the first tube to be screwed into the threaded part of the container; the inner part of the second tube is connected to the liquid outlet; one end of the second tube is projecting also from one end of the first tube, has a cutting edge to sever said sealant and forms said fluid inlet; an annular space formed between the first and second tubes communicates with said gas inlet, and said one end of the second tube and outer wall of the first tube form the gas outlet.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENT

Figure 1:
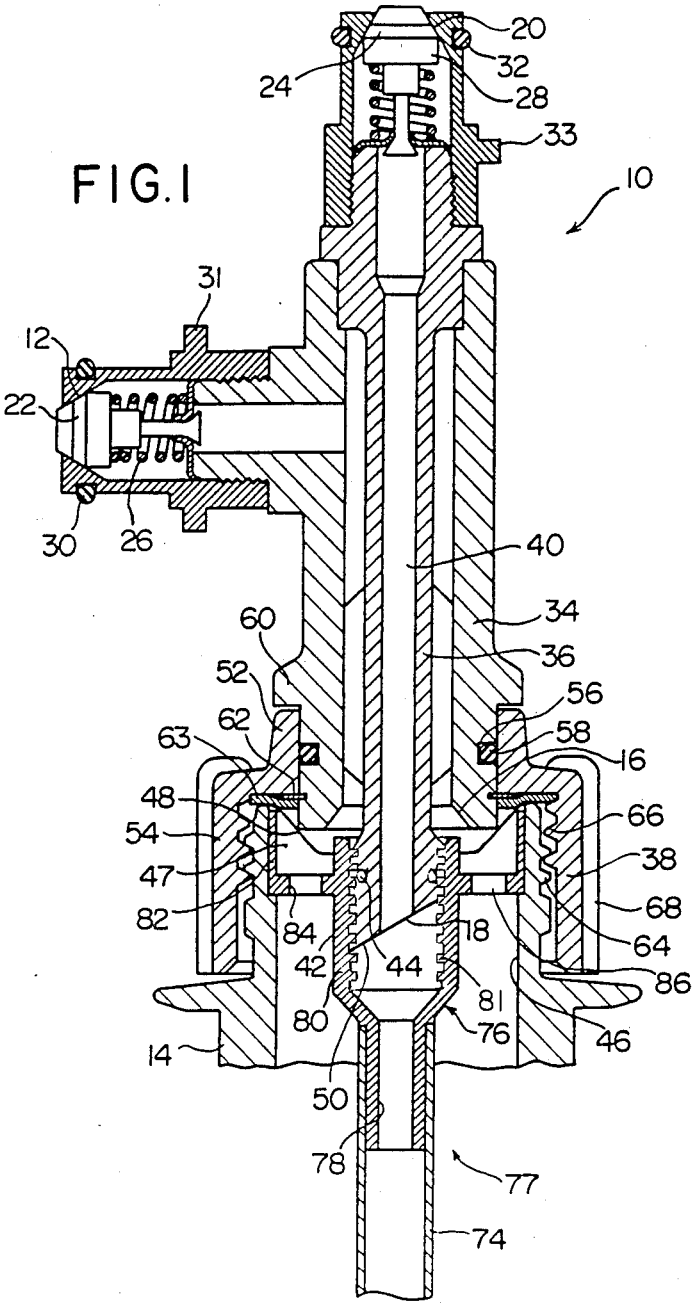
FIG. 1 is a vertical section of an attachment fastened to the container according to an appropriate working example of the present invention.

Next, an appropriate working example of the present invention will be explained by referring to FIGS. 1 and 2. Further, in FIGS. 1 and 2 the attachment according to the suitable working example of the invention is shown mounted on the container filled with a liquid.

An attachment 10 comprises a gas inlet 12 to which an inflow conduit (now shown) is connected, said inflow conduit being connected to a gas source, e.g., a carbon dioxide gas cylinder (not shown), a gas outlet 16 for causing gas to effuse into a container 14, a fluid inlet 18 for permitting a liquid, e.g. a concentrated syrup for soft drinks inside of the container 14, and a fluid outlet 20, for causing the fluid to effuse into an outflow conduit (not shown) to which said fluid outlet is connected.

In the gas inlet 12 and fluid outlet 20 there are mounted check valves 22 and 24 as shown, for instance. Check valves 22 and 24 are biased in a direction of the closed position by means of springs 26 and 28. By virtue of this, check valves 22 and 24 are usually closed. The interior and exterior of the gas inlet and fluid outlet are caused to communicate with each other in cases where the exterior has a sufficiently high pressure relative to the interior and where check valves 22 and 24 are inwardly forced mechanically by the projection made in the conduit to which they are connected. The gas inlet 12 and fluid outlet 20 are provided with O-rings 30 and 32 to ensure the sealing and connection as well as bosses 31 and 33.

The attachment 10 comprises a substantially cylindrical first tube 34, a substantially cylindrical second tube 36 and a threaded portion 38.

The first tube 34 and second tube 36 are connected at upper portions and are arranged coaxially. The second tube 36 comprises plural, e.g. four, ribs 40 which contact the inner wall of the first tube 34 so that these tubes 34 and 36 are arranged coaxially also in the lower portion. The upper end of an annular space formed by the first tube 34 and second tube 36 is sealed and communicates with the gas inlet 12 in the upper portion, as illustrated. The lower end of this annular space is opened, thereby to form a gas outlet 16. A hole formed in the second tube 36 communicates with a fluid outlet 20 at its upper end. The lower end is opened to form a fluid inlet 18. The lower end of the second tube 36 has a rather larger diameter than that of the upper portion, as shown. And on its outer periphery is formed a channel 44 housing an O-ring 42. A slant face is formed in the lower end of the second tube 36 and constitutes a cutting edge 50 to sever a sealant 48 sealing an opening 47 at the top of the neck 46 of the container 14.

A threaded portion 38 is rotatably disposed in the lower portion of the first tube 34. The inner diameter of an upper portion 52 of the threaded portion 38 is less than that of a lower portion 54 and is almost equal to the outer diameter of the lower portion of the first tube 34. An O-ring 58 is arranged within a channel 56 cut in the outer periphery of the lower portion of the first tube 34. By virtue of this, the threaded portion 38 is allowed to rotate while maintaining a seal at the lower part of the first tube 34.

An annular metal sheet 62 is fixed to the lower portion of the first tube 34, as shown. The upper portion 52 of the threaded portion 38 is arranged between a flanged part 60 and metal sheet 62, with a result that rotation centering about its central axis can be made freely, but longitudinal movement up and down is restricted. A sealing member 63 is disposed on the periphery of the upper portion 52 of the threaded portion 38, whereby a seal of the threaded portion 38 and the upper end of the neck 46 of the container 14 is formed when fastening the threaded portion 38 to the container 14. The inner wall of the lower portion 54 of the threaded portion 38 has a screw attached part 66 engaging with a threaded portion 64 of the container 14. The outer wall is provided with a concave and a convex shape (knurled), thereby to ensure its easy rotation.

The container 14 comprises a neck 46 having a threaded portion 64, as described above. An opening 47 at the end of the neck 46 is sealed with a thin sealant 48. This sealant 48 is severed by the cutting edge 50 when fastening the attachment 10 to the neck 46 of the container 14. The sealant 48 is a thin film in the form of three layers, polyethylene, aluminum and PET. With PET inside (container side) this sealant is bonded to the end of the neck 46 of the container 14 by heating, for example. The thin film for sealant 48 alternatively can be a three-layered film of aluminum (15$\mu$), polyethylen (50$\mu$) and hot-melt (5–10$\mu$) with the hot-melt inside. Further, a two-layered film of aluminum (15$\mu$) and PET (50$\mu$) with PET inside can also be employed.

Within the container 14 there are arranged, for example, a synthetic resinous tube 74 and a connection member 77 having a support 76 to support this tube 74.

Figure 2:
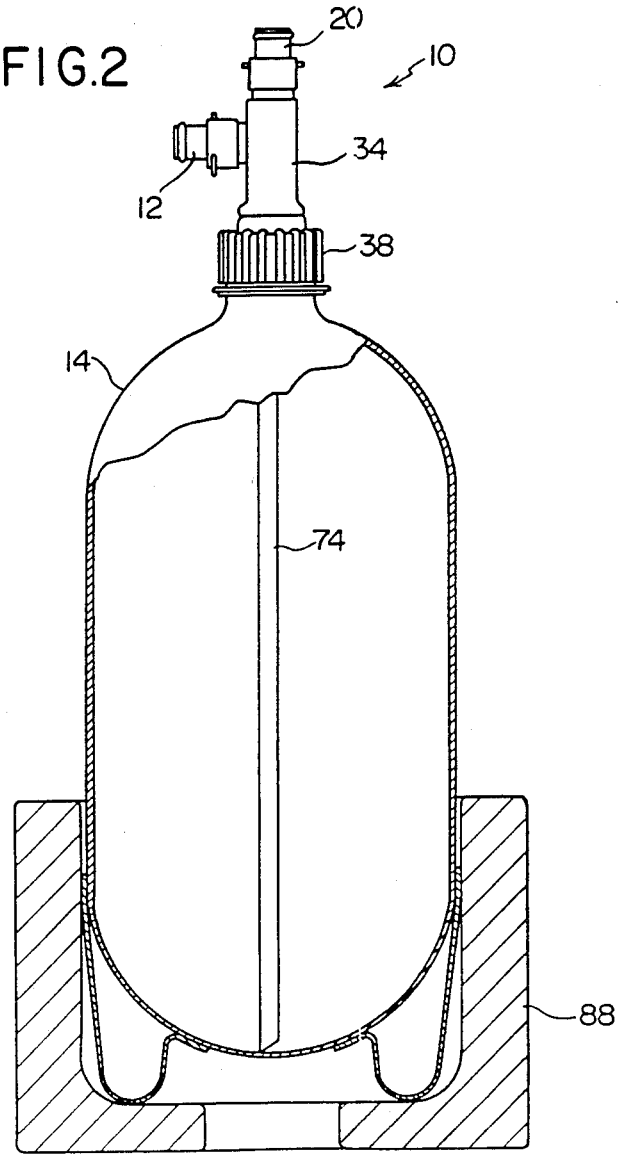
FIG. 2 is a side view of the attachment in FIG. 1 being fastened to the container located on a stand.

The tube 74 is extending to the bottom of the container 14, as shown in FIG. 2.

The support 76 comprises, as shown, a lower cylinder 78 connected to the tube 74, an upper cylinder 80 housing the lower end of the second tube 36, a cylindrical portion 82 formed into the neck 46 of the container 14 and a flange 84 for connecting the upper cylinder 80 to the cylindrical portion 82. The flange 84 is provided with plural, e.g. four openings, 86. The upper end of the upper cylinder 80 is provided with concave and convex shapes (knurled) in the form of rectangular ribs 81. Constructing so produces the following excellent effect. That is, when the attachment 10 is mounted on the neck 46 of the container 14, the sealant 48 disposed in the opening 46 at the end of the container 14 is severed by the cutting edge 50 formed in the lower end of the second tube 36, and then the lower end of the second tube 36 is housed in the upper cylinder 80 of the connection member 77. At which time the sealant 48 is resilient to some extent. Accordingly, there is some case where the sealant 48 is pulled by the lower end of the second tube 36 and contacts the upper end of the upper cylinder 80. As clearly shown in FIG. 1, a carbon dioxide gas is supplied via a space between the first tube 34 and the second tube 36, for example. This carbon dioxide gas is supplied into the container 14 via a space between the lower end of the first tube 34 and the upper end of the cylinder 80 and through an opening 86 made in the flange 84. Accordingly, if the sealant 48 contacts the upper end of the upper cylinder 80, this hinders the above supply of the carbon dioxide gas. Contrary to this, according to the illustrated concrete example, the upper end of the upper cylinder 80 is provided with a concave and a convex ribs, as above. By virtue of this, even if the sealant 48 contacts the upper end of the cylinder 80, the supply of the carbon dioxide gas will not be impeded. It is natural that an opening may be made in the neighborhood of the upper end of the upper cylinder 80.

As mentioned above, a syrup is filled in the container 14 at a syrup production factory. The opening 47 at the end of the neck 46 of the container 14 is sealed with the sealant 48 and then conveyed to the post-mix type soft drink vending machine, for instance.

In order to protect the sealant 48 during the conveying of containers and prevent its contamination, a cap (not shown) is screwed into the opening 47 at the end of the neck 46 of the container 14 after sealing with the sealant 48.

In an automatic vending machine, the container 14 is supported by a stand 88 as shown in FIG. 2 in a normally placed state.

Next, mounting the above attachment 10 on the container 14 and its function will be explained.

For example, the container 14 being filled with a concentrated syrup for soft drinks, being sealed with the sealant 48 and having a cap (not shown) fastened to the neck 46, is supported by the stand 88 in a normal state, i.e., a state of the neck 46 being positioned upward).

The cap is removed and the sealant 48 is severed by the cutting edge 50 mounted at the tip of the second tube 36, and the top end of the second tube 36 is inserted into the container 14, and the screwed portion 38 is screwed into the threaded portion 64 of the container 14 firmly. By virtue of this, the upper end of the neck 46 of the container 14 is pressed against the back of the sealing member 63 of the screwed portion 38, as illustrated in FIG. 1. Thus, the inside portion of the container 14 is sealed relative to the exterior, and the top end of the second tube 36 is housed within the upper cylinder 80 of the support 76. The inside part of the second tube 36 is caused to communicate with the lower cylinder 78 of the support 76 and tube 74.

Next, the gas inlet 12 of the attachment 10 is connected to a $CO_2$ gas cylinder (not shown) by an inflow conduit (not shown) via an appropriate control valve (not shown). The inflow conduit has an adequate projection for moving the check valve 22 inwardly, while the fluid outlet 20 is also connected to an outflow conduit (not shown). The outflow conduit has also a projection for moving the non-return valve 24 inwardly.

By the above arrangement, the control valve is operated, thereby to supply a carbon dioxide gas to the gas inlet 12 from the carbon dioxide gas cylinder (not shown). This carbon dioxide gas is supplied into the container 14 through the gas inlet 12, an annular space formed between the first tube 34 and the second tube 36 and gas outlet 16. The carbon dioxide gas is supplied into the container 14, thereby to pressurize the liquid housed in the container 14.

To the fluid outlet 20 is connected an outflow conduit (not shown) provided with a projection for moving the non-return valve 24 inwardly. The exhaust port of this outflow conduit is situated above a cup arranged in the determined position. And this outflow conduit is provided with any adequate control valve (not shown). Since the pressure of the carbon dioxide gas is exerted on the liquid within the container 14, the liquid is supplied into a cup via the tube 74, lower cylinder 78 and upper cylinder 80 of the support 76, fluid inlet 18, second tube 36, fluid outlet 20 and outflow conduit by opening the above control valve. Where the liquid in the container 14 is a concentrated syrup for soft drinks, a diluent solution, e.g. water or carbonated water, is fed into the cup by means of the known mechanism.

The attachment of the present invention having the above construction, can be fastened to the container in an upright state for filling the container. By virtue of this, an operator is not forced to spend extra work for inverting the container and additional units for hanging the container are not required. Further, it is possible to avoid problems such as contamination brought about by inverting the container.

Further, in the attachment of the invention, the second tube is arranged coaxially relative to the first tube and within the first tube. Via this second tube the liquid in the container is discharged. This enables one to locate the tube disposed in the container centrally in the neck of the container. As a result, it is possible to simplify the structure of a support for supporting this tube and for communicating this tube with the second tube.

Further, in the attachment of the present invention, the second tube for discharging the liquid is located within the first tube, as above, and the second tube is projecting from the first tube. The opening of a container provided with the attachment of the present invention is sealed with a sealant, and this sealant is cut by the attachment of the present invention. In such case, there is a risk of part of the severed sealant clogging a tube for discharging the liquid. While, in the attachment of the present invention the risk becomes small by the above construction that part of the sealant may clog the second tube for discharging the liquid.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An attachment for use in discharging a liquid from an upright container filled with the liquid having a threaded portion at the neck and an opening at the end of the neck sealed with a thin sealant, said attachment comprising a gas inlet for causing gas to flow into the container through an inflow conduit connected to a gas source, a gas outlet for causing gas to effuse into said container, a fluid inlet for causing a liquid to flow into the attachment from the internal part of the container and a fluid outlet for causing the fluid to effuse into an outflow conduit to which said fluid outlet is connected, the attachment comprising: a first tube, a second tube arranged coaxially relative to the first tube and inside the first tube, and a threaded part supported by the first tube to be screwed onto the threaded portion of the container; the inner part of the second tube being connected to the liquid outlet; one end of the second tube projecting beyond one end of the first tube having a cutting edge to sever said sealant and forming said fluid inlet; an outer diameter of the portion of the second tube projecting beyond said one end of the first tube being larger than that of the portion inboard of said portion of the second tube; an annular space formed between the first and second tubes communicating with said gas inlet, and said one end of the second tube and outer wall of the first tube forming the gas outlet.

2. The attachment according to claim 1 wherein the threaded part is rotatably disposed on the first tube.

3. A connection member located on an upright container filled with a liquid being connection to an attachment for use in discharging the liquid from the container having a threaded portion at the neck and an opening at the end of the neck sealed with a thin sealant, said attachment comprising: a gas inlet for causing gas to flow into the container through an inflow conduit connected to a gas source, a gas outlet for causing gas to effuse into said container, a fluid inlet for causing liquid to flow in from the internal part of the container and a fluid outlet for causing the fluid to effuse into an outflow conduit to which said fluid outlet is connected, a support fastened to an internal part of the neck of the container and a tube extending from said support to the bottom of the container, said support comprising an outer periphery fastened to the inner wall of said neck, a cylindrical portion communicating with said attachment wherein the upper inner surface of said cylindrical portion is provided with concave and convex shapes defining ribs for securing the fluid inlet of said attachment and providing an alternative path for gas to effuse into said container if said gas outlet is blocked, and a horizontal support member connected to said outer periphery for supporting said cylindrical portion, said horizontal support member having openings allowing gas to advance from said attachment and to effuse into said container.

4. The connection member according to claim 3 wherein an opening is formed in the neighborhood of the upper end of said cylindrical portion.

* * * * *